US005411229A

United States Patent [19]

Hoefkes

[11] Patent Number: 5,411,229

[45] Date of Patent: May 2, 1995

[54] BAG HOLDER

[76] Inventor: Heiner Hoefkes, 2285 Dunwin Drive, Unit 4, Mississauga, Ontario, Canada, L5L 3S3

[21] Appl. No.: 168,202

[22] Filed: Dec. 17, 1993

[51] Int. Cl.[6] ..... A63B 55/04

[52] U.S. Cl. ..... 248/97; 248/99; 248/101

[58] Field of Search ..... 248/95, 97, 99, 101, 248/150, 153, 167

[56] References Cited

U.S. PATENT DOCUMENTS

| | | | |
|---|---|---|---|
| 2,995,329 | 8/1961 | Talcott, Jr. | 248/97 |
| 3,374,976 | 3/1968 | Kurlander et al. | 248/97 |
| 3,412,965 | 11/1968 | Alexander | 248/101 |
| 3,640,495 | 2/1972 | Dietz | 248/101 X |
| 4,667,912 | 5/1987 | De Vilbiss | 248/150 X |
| 4,723,741 | 2/1988 | Doering | 248/97 |
| 4,783,031 | 11/1988 | Ebentheuer | 248/97 |
| 4,896,853 | 1/1990 | Nyzen | 248/97 |
| 4,946,118 | 8/1990 | Hastings | 248/101 X |
| 4,955,566 | 9/1990 | Bolich | 248/101 |

*Primary Examiner*—Alvin C. Chin-Shue
*Assistant Examiner*—Derek J. Berger

[57] ABSTRACT

A bag holder has two frames each with a standard. The standards are swingably connected to diverge in a V. A clamp member will clamp a bag to each frame so that it may be open when the V is present. A torsion spring biases the frames toward one parallel position and away from the other. A pair torsion springs connecting the frame provides a convenient hinge.

13 Claims, 6 Drawing Sheets

FIG.6.
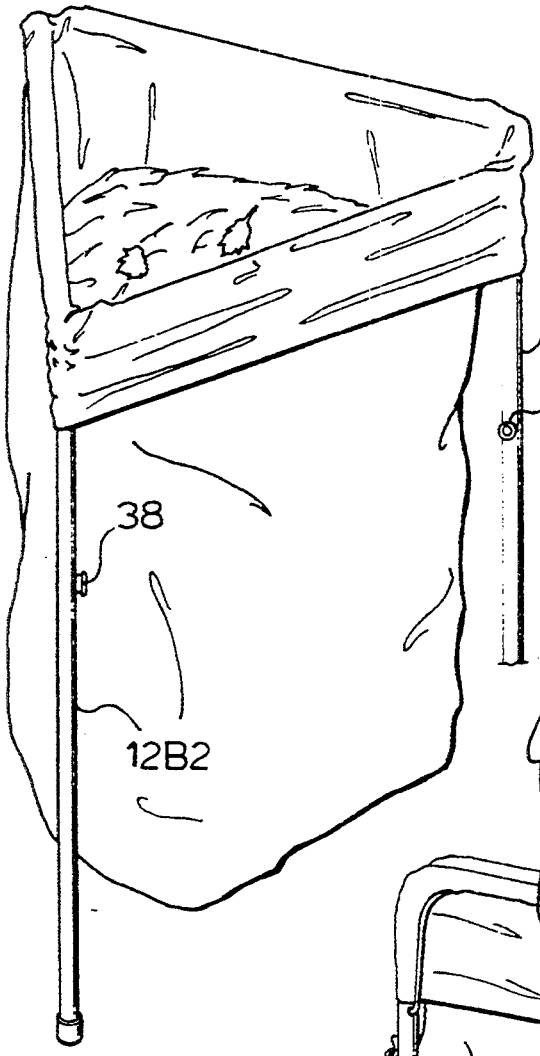
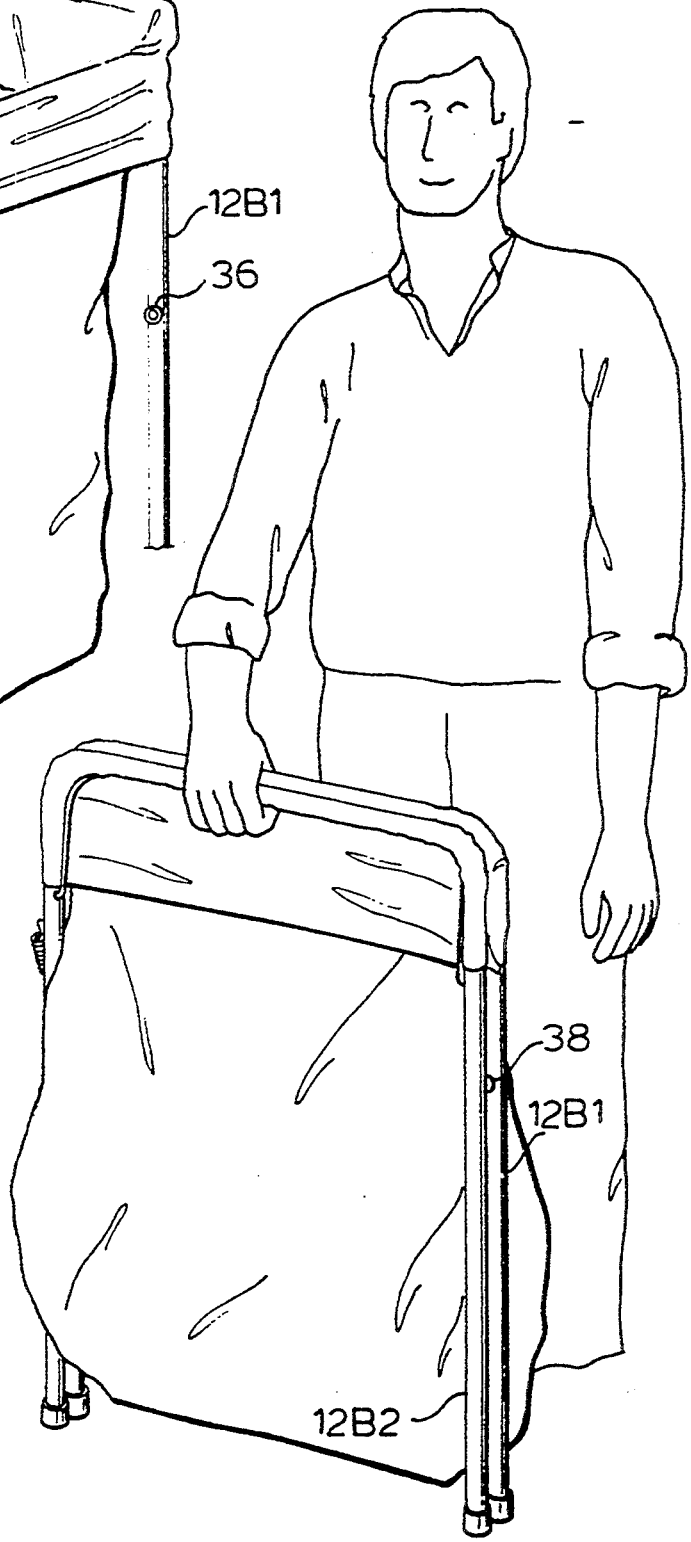
FIG.7.

BAG HOLDER

This invention relates to a stand for bags which are used for collecting garbage, leaves and the like and to a hinge for said stand. By the term 'bag' hereafter I refer to bags of this type.

There are many holders presently for such bags. These are of many types and the faults or inconvenience associated with them are varied but, most commonly, they include: they are inconvenient to erect, they tend to collapse, difficulties are encountered in attaching and detaching the bags, some are unstable and with most it is difficult or impractical to carry the bag when filled or partly filled.

It is an object of my invention to provide a stand for a bag which is easy to erect and to collapse and which conveniently holds a bag in open position when erected.

It is an object of my invention to provide a stand for bags where attachment and detachment of the bag is quick and convenient.

It is an object of my invention to provide a stand for bags where, when the bag is attached, the stand is adapted to hold the bag in open position and where the stand and open bag may be arranged in an attitude approximating the form of an equilateral triangle in plan, allowing for stability and for the compact placing of such bag stands side by side, in close array.

It is an object of my invention to provide a stand for bags where such stand will hold the bag open but may be closed with a filled or partly filled bag to carry the bag and stand from place to place.

In accord with the invention, a stand is provided comprising a pair of frames. Each frame comprises a pair of standards and a main cross-bar joining them adjacent their upper end to form an inverted U. The main cross-bar is adapted to be horizontal when the lower ends of said standards are resting on a support surface. A first standard of one frame is located side by side with a first standard of the other and swingably connected to it, hence the two frames are swingably connected. Each frame mounts a clamping means adapted to move a clamp bar, with a snap action, past the main cross-bar and transversely thereto. Thus a bag may be clamped to a main cross-bar by folding an upper portion of the bag over the cross-bar and moving the clamp bar past the cross-bar to move with a snap action toward the remainder of the bag. This has the effect of clamping the bag to the main cross-bar. Thus when the frames are arranged at about 60° to each other, the bags may be placed in the V and clamped to the main cross-bar. The material of the bag forms the third side of an equilateral triangle, with the bag open within such triangle. In a preferred form of the invention, the swingably connected frames are biassed toward opening beyond the about 60° angle, hence stretching the bag material taut between the free sides of the frames, to form a stand with a stable open bag. In a further preferred form the bag carrying frame just described, may be pivotted to side by side and carried, even though the bag is partly or nearly full. In a preferred arrangement releasable fasteners, preferably snap fasteners are provided for holding the main cross-bars together, against the bias, to hold the bag closed.

In some aspects of the invention, therefore, a pair of U-shaped frames, each having the form of an inverted U shape have first standards maintained side by side and second standards free to move about an arc relative thereto from a position where the frames are side by side with one pair of sides facing each other to a position where the frames are side by side with the other pair of sides facing each other. In angles given herein I prefer to use the convention that each frame is rotated 180° between these positions. It will also be noted in a preferred embodiment that each of the frames is rotated 150° from the first side by side position to the orientation where they are at 60° to each other.

There are two types of springs which, in relaxed position form a close wound helix. One type is used solely for its tensile pull as the turns are pulled apart and it exerts minimal and inconsequential torsional stress.. The other type, as well as exerting tensile stress when its turns are pulled apart, has a strong torsional strength. That is if the ends are rotated either way from the rest position about the axis of the spring the spring strongly biasses the ends in a direction to return to the spring's rest position, It is the latter type of spring with which preferred embodiments of this invention are concerned and it is referred to herein as a torsion coiled spring.

The invention also provides a combination hinge and biasing means useful for swingably connecting the frames together. In accord with this aspect of the invention, a standard from each frame is located side by side. Torsion members, preferably torsion coiled springs are located near each end of each of the standards. Each torsion member extends from a location on one standard to a location nearer the end on the other standard. The two torsion members, collectively, provide equal and opposite relative longitudinal stress components the side by side standards so that these tend not to move longitudinal relative to each other. Torsionally however, the torsion members bias the standards in such a way that the frames, when allowed, rotate relative to each other to closed side by side position, and the torsion members are mounted to maintain the bias in such closed position. On the other hand the torsion members allow rotation of one frame relative to the other, against the bias, through 180° so that the frames are again parallel in side by side reverse position.

In operation then with the parallel frames in side by side closed, the frames are rotated through about 150° toward open position, so that they define slightly less than 60° V between them in plan. The feet are used to hold the frames against opening with the bias while the bag, placed within the V has its upper portion clamped to each cross-bar. After clamping, the frames may be released. Moving under the bias they will stretch the upper portion of the bag taut between their free sides and the bag in turn will hold the frames against further opening. Correct positioning of the bag when clamped to the cross-bars will mean that they render the bag taut and in turn are held by it at an angle of 60° so that the frame and the bag define an opening that in plan view is approximately an equilateral triangle.

The invention as defined in the previous paragraph provides means, when both frames have been rotated 180° (so that the frames are side by side) with detachable means, preferably snap fastener components on then facing portions of the free standards for attachment. With such attachment means the frames may be held in TENSION position to hold closed the top of a filled or partly filled bag attached to the frame and provide the ability for carrying it.

In drawings which illustrate a preferred embodiment of the invention:

FIG. 6 shows the clamped bag from another position,

FIG. 7 shows a partly filled bag being carried in the frame,

Figure 4:
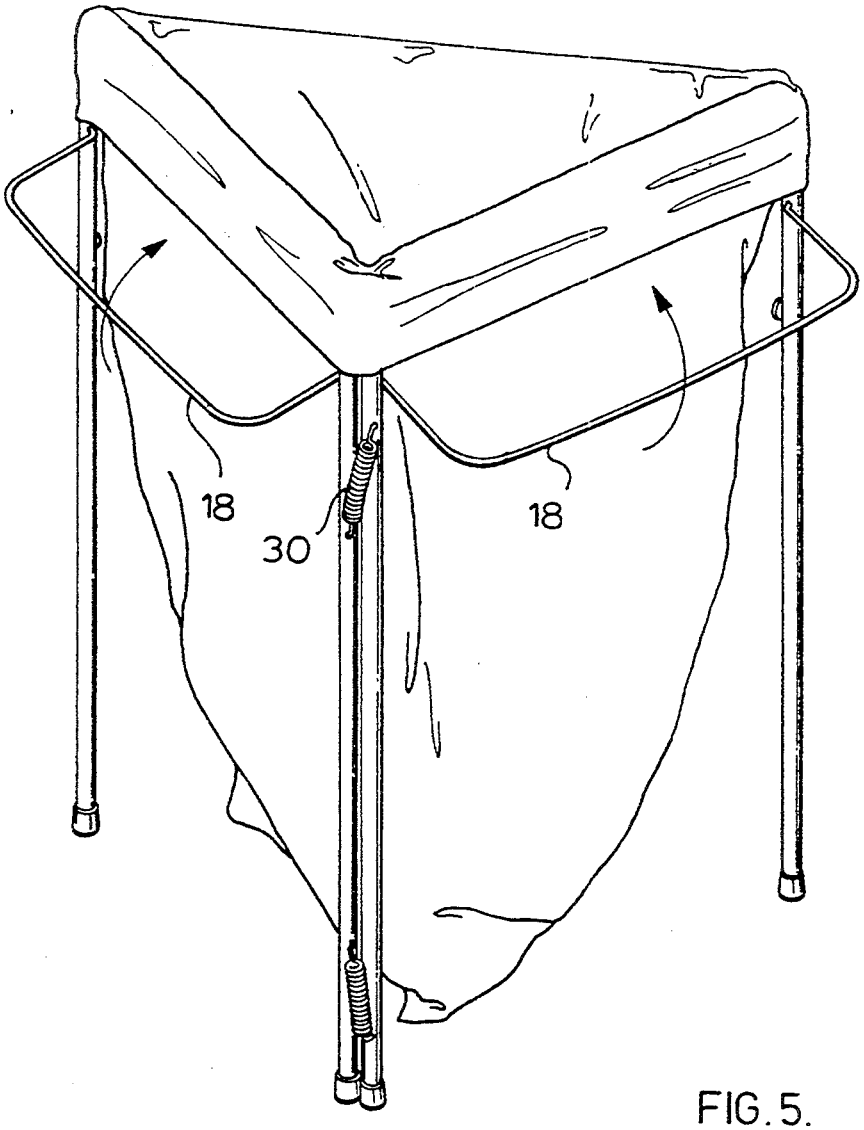
FIG. 4 shows a bag on the frame ready for clamping.
Figure 5:
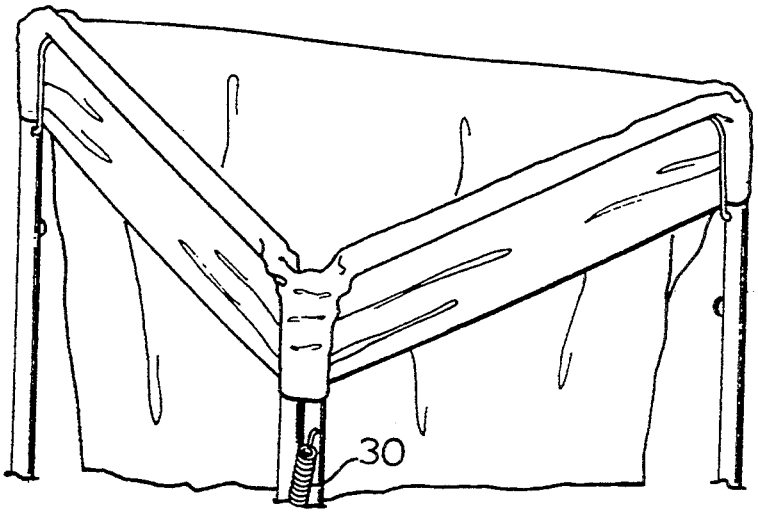
FIG. 5 shows a bag clamped to the frame.
Figure 8:
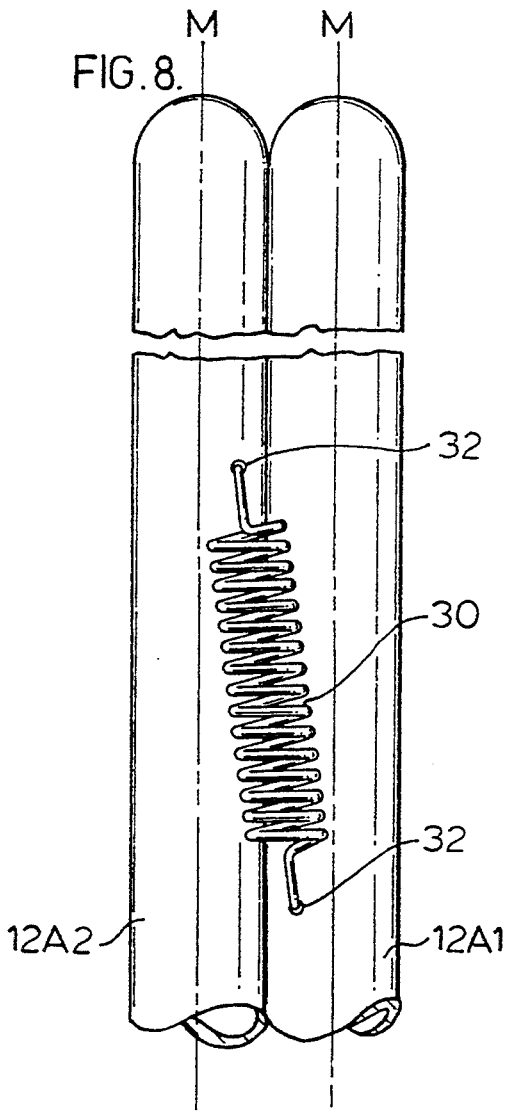
Figure 9:
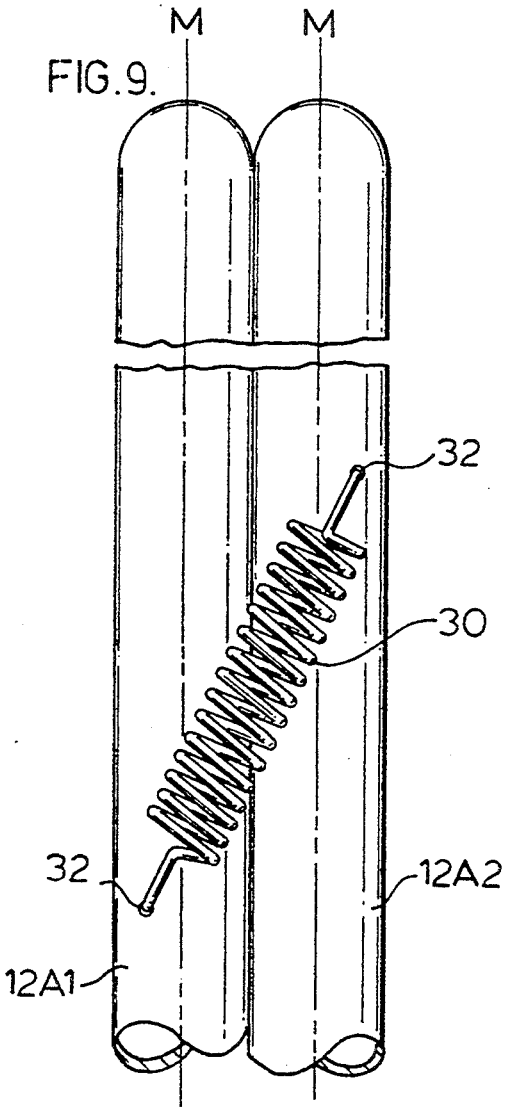
Figure 10:
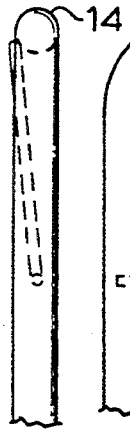
Figure 11:
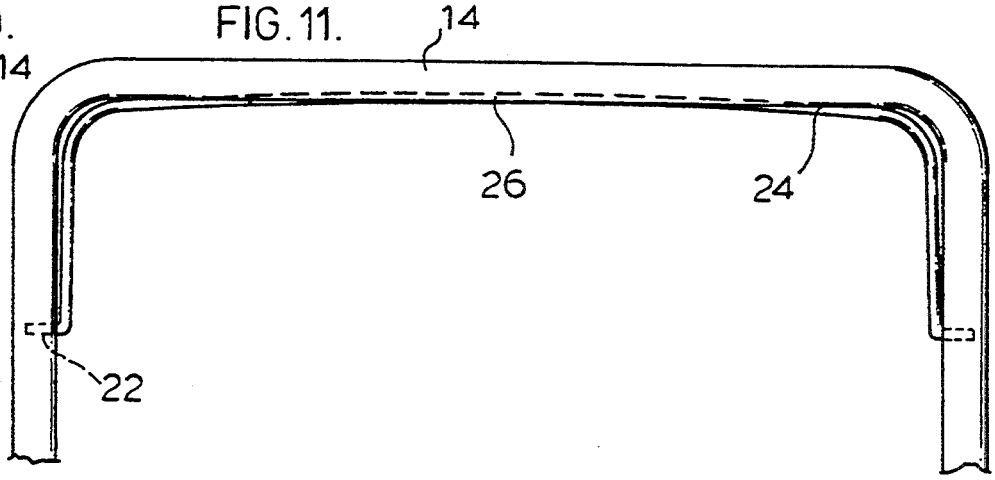
Figure 12:
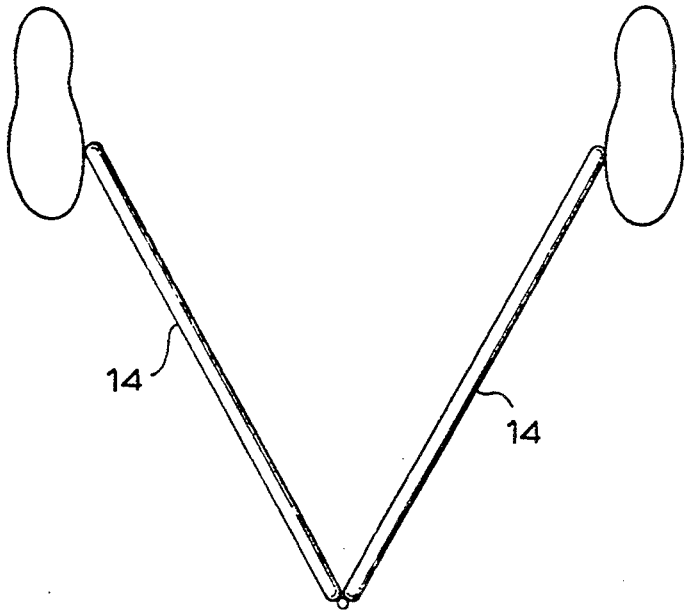
Figure 13:
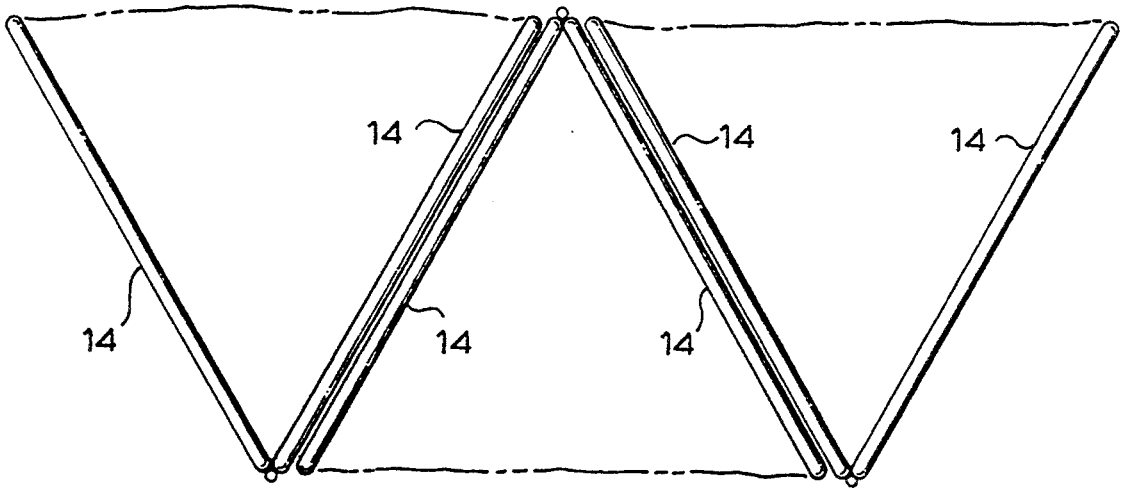

FIGS. 8 and 9 show the anchorage for the torsion coiled spring in rest and reversed position, respectively, FIGS. 10 and 11 are fragmentary view of the bag clamping means in end and side view, respectively, FIG. 12 demonstrates, in plan, a step of bag attachment, FIG. 13 shows the packing quality of inventive stands, In the drawings a stand has a pair of frames 10 of inverted U shape, each have two parallel standards 12A swingably connected (the 'first' or 'connected' standards) while their counterpart standards 12B are sometimes referred to as 'second' or 'free' standards. On each sub-frame a clamp bar is of a U shape with clamp-bar 18, uprights 20 and stub ends 22 projecting from the ends of the uprights 20. The stub ends 22 are receivable in facing apertures 24 in standards 12A and 12B to allow pivotting of the clamp bar 18, about the stub ends, relative to the standards 12. The clamp bar 18 is made from resilient material so that it may be bowed to allow insertion of the stub shafts in the apertures. The clamp bar 18 is dimensioned relative to the spacing of the apertures from the frame cross-bar 14 so that; when the clamp bar 18 is rotated up to the cross-bar 14, it passes the latter with a snap action, assisted in this regard by the resiliency of the clamp bar. It will also be helpful if clamp bar is centrally slightly bowed at 26, away from the stub shaft axis, as shown in FIG. 11. It will thus be seen that an upper portion of a garbage bag may be folded over a cross-bar 14 to leave a portion of the bag hanging down (FIG. 4). The clamp bar 18 may then be rotated against the depending portion of the bag snap past the cross bar (FIG. 5). If stresses then pull on the bag tending to pull out its upper portion this increases the clamping action of bar 18 on the bag.

Figure 1:
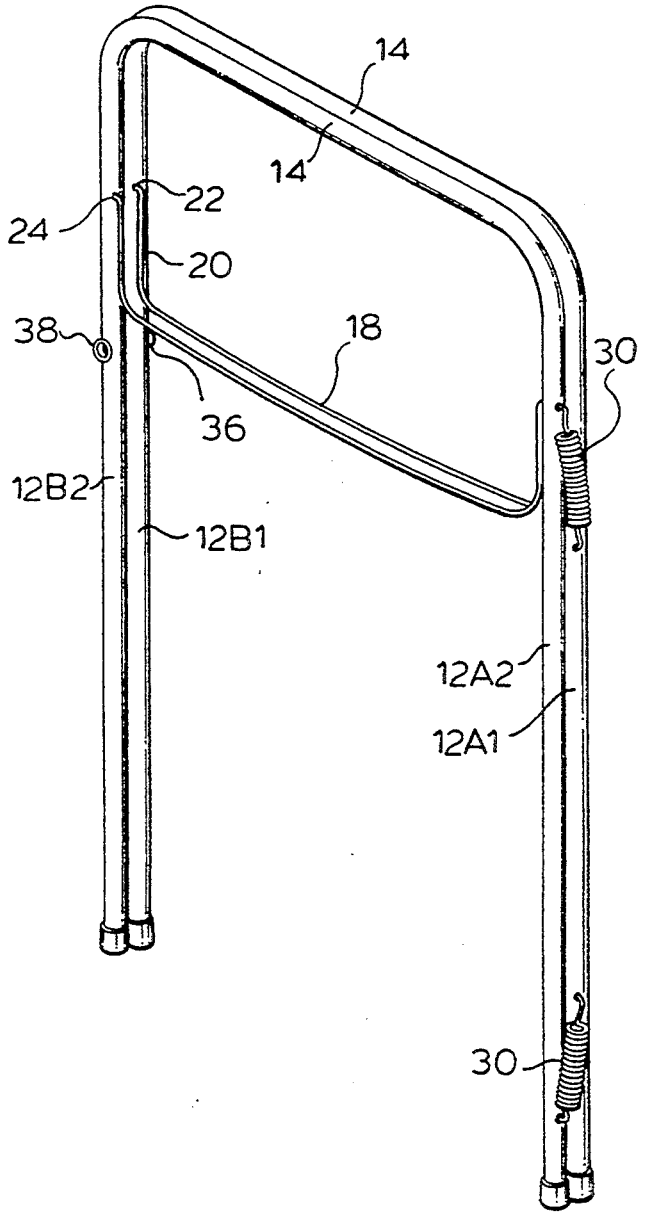
FIG. 1 shows frames in side by side closed position.
Figure 2:
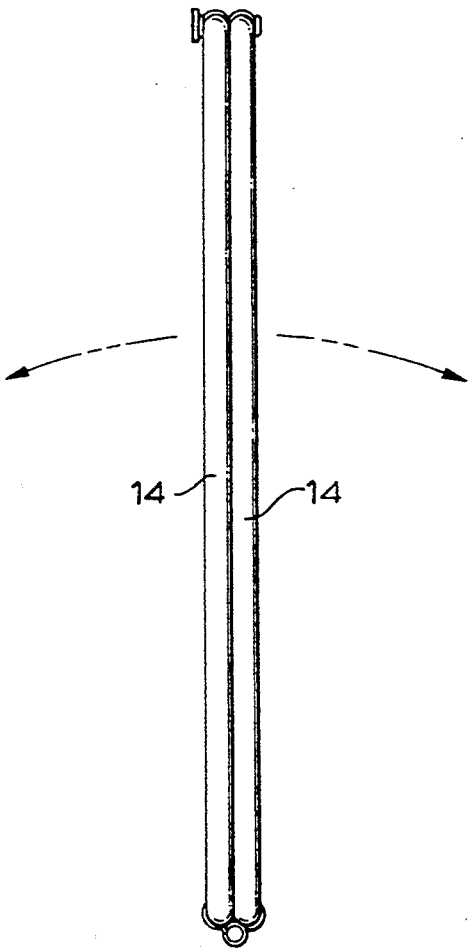
FIG. 2 shows the direction of movement of the frames toward open position.
Figure 3:
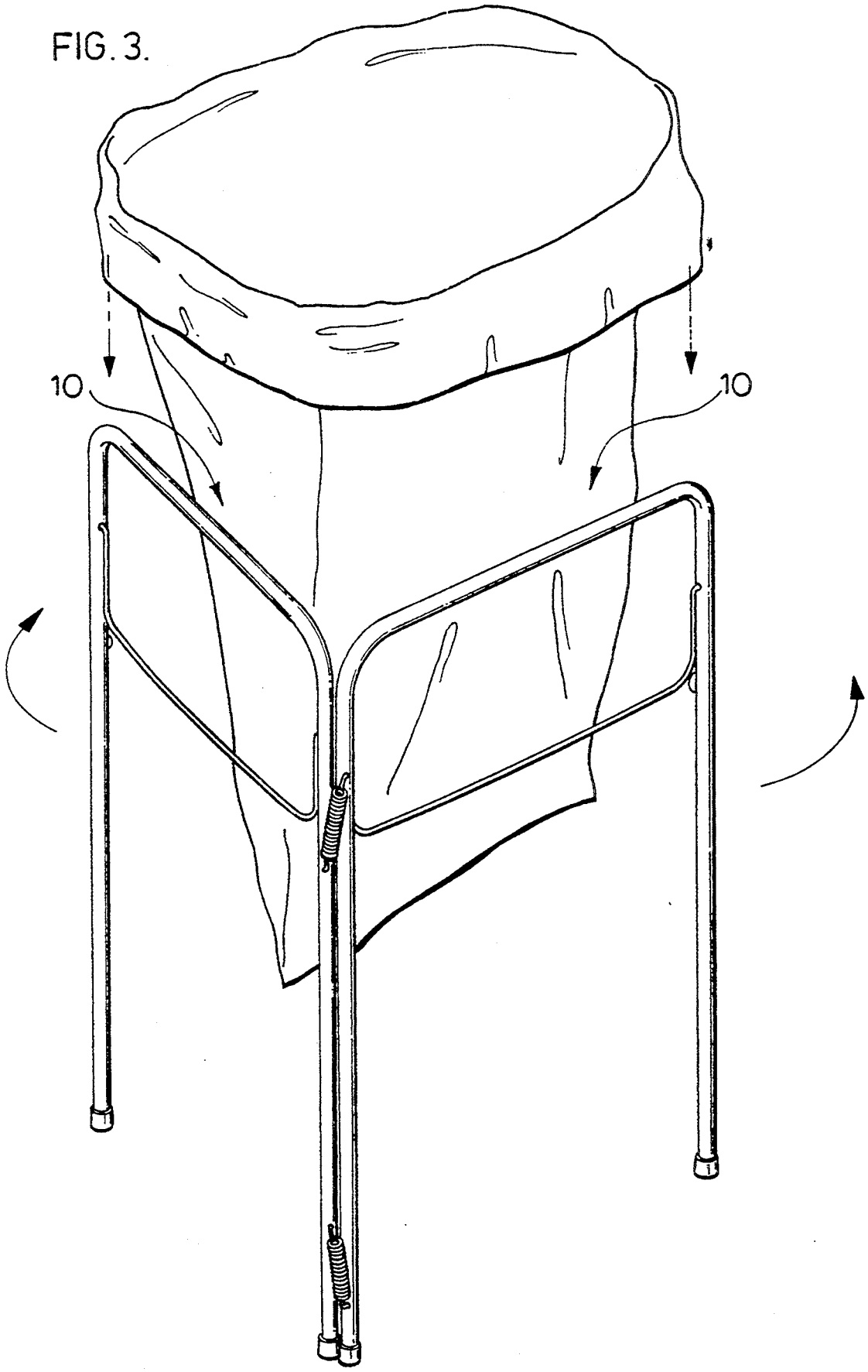
FIG. 3 shows the frames in perspective.

With the two frames considered as side-by-side they have a rest position facing each other in one direction FIGS. 1,2 and 8 (the 'rest' position) and rotated through 180° (again side by side) face each other in the opposite direction as 'the reverse position' (FIGS. 9 and 7). A pair of coil torsion springs 30 join the two standards 12A. One spring 30 is located toward each end of the standards and goes from a position near the end of one of the standard 12A1 to a position nearer the end of the other standard 12A2. The connecting apertures 32 for the ends of the springs are located so that in the rest position the torsion of both springs 30 biases the standards toward rest position. It will be noted that, in the rest position the apertures 32 are closer than the median plane for the frame (FIG. 8).

The springs 30 are chosen to be of equal strength and hence exert opposite longitudinal stresses on the connected uprights 12A1 and 12A2. This increases the torsional and tension stresses on the coiled springs 30, which are installed with the required twist to bias the frames together to rest position.

The right or left handedness of a coiled spring does not matter. It has a rest attitude. When it is flexed by movement from the rest attitude it will exert torsion tending to return it to rest position whether the flexure is in a sense to tighten or loosen the coils. Male and female snap fastener elements 36 and 38 are located on the sides of standards 12B1 and 12B2 which face in the reverse position (FIG. 7 and 9) and are located so that they may be snapped together and hold the frames in reverse position against the spring bias.

In operation, the frames are in rest position (FIG. 1,2 and 8). With garbage bag in hand they are then rotated a little more than 150° toward reversed position and maintained in position against the bias toward rest position preferably by the user's feet (FIG. 12). The cross-bars 14 are then at a little less than 60° to each other.

While the uprights are thus held against expanding, a bag, open upwardly is located in the 'V' of the uprights. Lengths of the upper portion of the bag are folded outwardly over the uprights 14 and clamped by inward snapping of clamping bar 18 to clamp each upper bag portion against the cross-bar.

If this is done with practice the length of the bag between the free uprights is approximately the length of an upright 14. The frames are released so the springs 30 are allowed to tauten the bag and stably support an open upward bag in the approximate shape of an equilateral triangle. The tension on the bag renders more positive the clamping action of clamping bars 18.

The bag may then be filled from above or may be turned on its side for rolling in leaves or the like.

If it is desired to close a partly filled bag the frames are rotated to reverse position (FIG. 7) the snap fasteners 36, 38 are closed so that they will hold the frames in reverse position against the spring bias. The side by side bars 14 allow simple carrying of the partly filled bag from place to place.

When it is desired to remove the bag the clamps are removed. With the bag removed, the frames rotate under the spring bias to rest postion for storage.

It will be noted from FIG. 13 that the preferred arrangement of the held bag, forming (approximate) equilateral triangle in plan view allow 'packing' of a number of these containers in a confined space because of the 'packing' qualities of an equilateral triangle.

FIGS. 8 and 9 indicate the median planes of the frames by the line M. These Figures demonstrate that location of the apertures 32 for springs 30 so that they are closer than the median planes in rest position (FIG. 8) and farther than the median planes in reverse position (FIG. 9) increases the spring torsion as well as the spring tension, both increasing the bias toward rest position provided by the spring.

I claim:

1. Bag holder comprising:

a pair of frames, each in the form of an inverted U each frame comprising a pair of standards, each defining a longitudinal direction adapted for vertical orientation and a cross-bar joining the upper ends of the standards, means swingably connecting a standard of one frame with a standard of the other frame for relative rotation relative to each other about a connection axis parallel to the longitudinal direction of said standards, a clamp member connecting each pair of standards and mounted on said standards to pivot about a substantially horizontal axis relative to said standards to and from a location where it passes beneath the cross-bar connecting the pair of standards, with a snap action.

2. Bag holder as claimed in claim 1, wherein said clamp member is a U shaped member pivotally mounted on opposed standards to pivot about an axis perpendicular to said standards past an upper position and providing a clamp bar parallel to and adapted to make said snap action when passing beneathb 54109715.001 said main cross-bar.

3. Bag holder as claimed in 2 wherein said frames are adapted to swing relative to each other about said connection axis through a rang between rest and reverse positions where said frames are parallel at each end of said range, and means adapted over said range, to bias said frames toward swinging relative to each other toward said rest position.

4. Bag holder as claimed in claim 3, wherein means are provided for releasably fastening said frame in said rest position.

5. Bag holder as claimed in claim 3, wherein said biasing means are comprised by a pair of resilient torsion coil springs said pair of standards on a frame comprising a first standard and a second standard, each said torsion coil spring having one end connected to one of said first standards at spaced locations, . each said torsion coiled spring extending from said one of said first standards to a connection to the other of said first standards in a direction away from the other coiled spring.

6. Bag holder as claimed in 1 wherein said frames are adapted to swing relative to each other about said connection axis through a range between rest and reverse positions where said frames are parallel at each end of said range, and means adapted over said range, to bias said frames toward swinging relative to each other toward said rest position.

7. Bag holder as claimed in claims 6, wherein means are provided for releasably fastening said frame in said rest positon.

8. Bag holder as claimed in claim 6 wherein said biasing means are comprised by a pair of resilient torsion coil springs said pair of standards on a frame comprising a first standard and a second standard, each said torsion coil spring having one end connected to one of said first standards at spaced locations, each said torsion coiled spring extending from said one of said first standard to a connection to the other of said first standards in a direction away from the other coiled spring.

9. Bag holder comprising:

a pair of frames in the form of an inverted U, each frame comprising first and second standards adapted for vertical orientation and a main cross-bar, joining the upper ends of said standards, a pair of torsion coil springs each having one end joined to One of said first standards at spaced locations, each torsion coiled spring extending from said one of said first standards to the other of said first standards in a direction away from the other coiled spring, said torsion spring being adapted to maintain said respective first standards in substantially parallel relation, means for attaching a bag to said cross-bars.

10. Bag holder as claimed in claim 9 wherein said frames are adapted to swing relative about an axis substantially parallel to said first standards over a range from one position where said frames are parallel to another position where said frames are parallel where said torsion springs are adapted over said range, to bias said frames toward said one position.

11. In combination:

a pair of frames, each of inverted U shape formed by a pair of substantially parallel standards having free ends and joined at the other ends by a cross bar, each frame being adapted to rest with said free ends adapted to rest on a support surface, adapted when so resting to to locate said cross bar spaced from said surface, said frames being connected with a standard of one frame parallel and side by side with a standard of the other frame to allow said frames swing relative to each other about said axes, said frames being adapted to assume a relative position where said cross bars are about at 60° to each other, and means biassing said frames in a direction tending to increase said angle, said cross bars when at about 60° to each other to support a bag mainly located within said angle, having a portion of said bag clamped to each of said cross bars and a third portion extending between said cross bars at locations or said cross bars spaced from said connection.

12. In combination, as claimed in claim 11 wherein said clamped portions are located so that said third portion holds said cross bars at about 60° to each other.

13. Hinge for connecting two longitudinally extending side by side members, comprising:

two longitudinally extending side by side members, a pair of coil torsion springs, each at rest comprising a multiple turn close wound helix, each said torsion spring having one end connected to one of said members, at one location, and at the other end connected to the other of said members, at another location, longitudinally spaced from said one location, said torsion springs each extending from one location on said one of said members to a location on the other said member in a direction away from the other coiled spring.

* * * * *